United States Patent [19]

Arena

[11] 4,134,589

[45] Jan. 16, 1979

[54] GOLF SWING TRAINING DEVICE AND METHOD

[76] Inventor: Joseph C. Arena, 920 Swede St., Norristown, Pa. 19401

[21] Appl. No.: 819,697

[22] Filed: Jul. 28, 1977

[51] Int. Cl.[2] ..... A63B 69/36

[52] U.S. Cl. ..... 273/183 B; 273/188 R; 273/191 B; 272/139

[58] Field of Search ..... 273/188 R, 188 A, 189 R, 273/190 R, 183 B, 35 R, 191 B; 272/900, 126, 135, 137, 143, 119, 139; 35/129 A

[56] References Cited

U.S. PATENT DOCUMENTS

| | | | |
|---|---|---|---|
| 1,703,375 | 2/1929 | Volk | 273/188 R |
| 2,893,736 | 7/1959 | Tesi | 273/188 R |
| 3,109,244 | 11/1963 | Trifaro et al. | 273/189 R X |
| 3,595,583 | 7/1971 | Oppenheimer | 35/29 A X |
| 3,815,904 | 6/1974 | Weiss et al. | 272/137 X |
| 3,982,756 | 9/1976 | Hersey | 272/126 |
| 4,060,240 | 11/1977 | Dunston | 272/126 |

*Primary Examiner*—George J. Marlo

*Attorney, Agent, or Firm*—Paul & Paul

[57] ABSTRACT

A golfer's aid device is provided together with methods for its use to develop the proper golf swing. The device comprises a flexible substantially non-stretchable member forming a loop and extending upwardly in diverging relation from an aperture or pulley and includes grasps which adjustably engage the member and may be secured to trainee's belt loops or be held in the hands of the trainee. The aperture or pulley is securely anchored such that the trainee may utilize the device to practice the pivot. In one embodiment the device is secured to the belt loops of the trainee and utilized in conjunction with swinging a golf club. In another embodiment the trainee utilizes the device with the grasps of the device held in the trainee's hands for practicing the pivot. Another embodiment of the device utilizes a second member which is secured to a point approximately the proper placement of a golf ball looped over the rear shoulder of the trainee around his neck along his arm and is grasped in his hands.

4 Claims, 7 Drawing Figures

GOLF SWING TRAINING DEVICE AND METHOD

BACKGROUND OF THE INVENTION

1. Field of the Invention

The present invention relates to a device to practice pivoting, and more particularly to a golfer's aid to develop a simple and natural golf swing that is controlled by feel. The controlling feel is built up through the constant repetition of correct movements which are embodied in methods of utilizing the device.

2. Description of the Prior Art

Various devices have been heretofor proposed to golfers to improve their form, swing, etc., including mechanical restraining devices, which are awkward to use and distort the natural feel of the golf swing; inelastic guides secured to the waist from a point between and in back of the golfer's toes, which do not allow the proper extensability and stretching in balanced relation during the golf swing; elastic devices which tend to impose an unnatural force on the left arm or other portions of the golfer, etc. All such devices tend to mechanically guide the golfer's swing and body movements thereby encumbering the natural feel of the golf swing, complicating the golf swing and not lending themselves to development of a simple swing that can be effortlessly and consistently continued in play without use of such restraints, guides, etc.

SUMMARY OF THE INVENTION

The foregoing objections are overcome by the present invention, which I call the "Silent Golf Pro". When properly used, it will assist in developing a swing which is built through the constant repetition of correct natural movements. The swing will be controlled by feel and will improve the golfer's game. My invention is based upon the premise that a good golf game has as its basis the proper pivot and that when combined with the proper grip, the golfer will master the conception and feel of the correct golf swing.

The present invention provides a flexible substantially non-stretchable member forming a loop at one end and extending upwardly in diverging relation to form two portions wherein each said portion further includes grasping means, which can be adjusted to nonslipably engage said portions for securing said portions to said trainee, apertured means for engaging said loop and permitting said loop to freely pass therethrough, and anchoring means engageable with said apertured means for anchoring the same at a point located in front of and at a predetermined distance from said trainee's feet. The golfer can develop the proper pivot by engaging the grasping means of the silent golf pro in each hand keeping each arm bent with the upper arms retained substantially parallel and adjacent to the golfer's sides, with the forearm bent such that the hands of the trainee properly receive the grasping means. The grasping means are positioned to engage the hands in taut condition and as thus described, the trainee practices pivoting utilizing the silent golf pro. In another embodiment, each of the portions of the member are secured to the opposite sides of the golfer's waist enabling him to properly pivot while swinging a golf club. In yet another embodiment, the silent golf pro is used in conjunction with the last mentioned method, and additionally includes a second member secured to an anchoring means placed at a distance beyond the approximate location of a golf ball and extending upwardly over the rear shoulder of the golfer and around his neck and then downwardly along his left arm to his hand where it is grasped.

Accordingly, the principal object of the present invention is to provide a simple golfer's aid for use in practicing a proper pivot which will aid in the development of a natural and simple swing that can be effortlessly continued subsequently without the use of the golfer's aid.

Another object is to provide a golfer's aid that will enable a golfer to develop a swing that is controlled by feel, which can be built up through the constant repetition of correct pivoting and therefore, body movements.

Another object is to provide a golfer's aid that can be used by either left handed or right handed golfers, and can be adjusted for use by all golfers, regardless of their height, length of their arms, etc., and can be used indoors and outdoors.

A further object is to provide a method for using the device to develop a good pivot, which provides a central organization for a proper golf swing.

Other objects and advantages of the present invention will be apparent from a reading of the specification, the drawings, and the appended claims.

DESCRIPTION OF THE DRAWINGS

A preferred embodiment of the invention selected for purposes of illustration is shown in the accompanying drawings, in which:

FIG. 2 is a perspective view illustrating the present golfer's aid as it would normally be used to develop his pivot, and illustrates the proper position of the golfer practicing his down-swing and follow-through.

FIG. 4 is an enlarged perspective view of the golfer's aid device of the present invention.

DESCRIPTION OF THE PREFERRED EMBODIMENT

Figure 1:
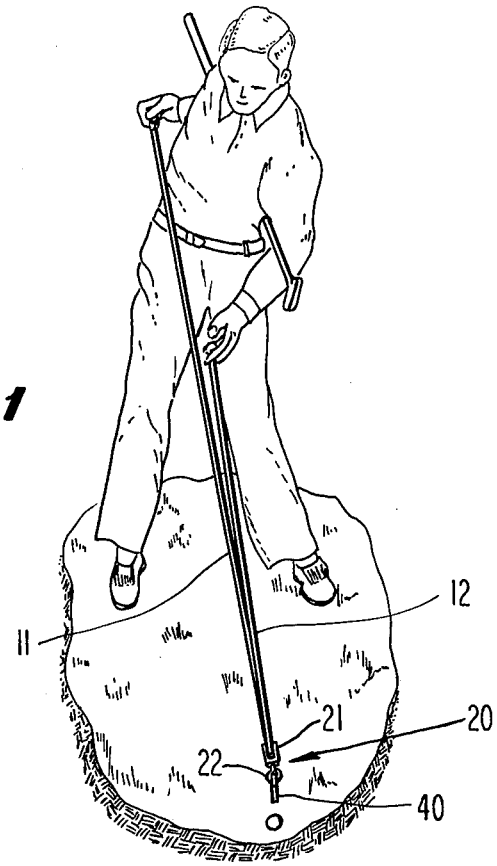
FIG. 1 is a perspective view illustrating the present golfer's aid as it would be used to develop the proper pivot, and illustrates the proper position of a right-handed golfer practicing his back-swing.

Referring to FIG. 4, an enlarged view of the golfer's aid device 1 of the present invention is illustrated. The device comprises a flexible substantially non-stretchable member 10 forming a loop about apertured means 20 and extending upwardly in diverging relation to form portions 11 and 12. Grasping means are provided by zig-zagged-type shaped clips 30 which are designed to non-slipably engage portions 11 and 12 at various selected positions along portions 11 and 12. Clips 30 engage portions 11 and 12 at bent portions 35. The remaining portion 37 of clip 30 is then free to engage the belt loops of the trainee's pants (see FIG. 3) or may be hand held by the trainee or may be inserted into a wiffle golf ball (not shown) the latter of which may be comfortably hand held by the trainee (see FIGS. 1 and 2).

In the preferred embodiment, apertured means 20 is a pulley mechanism comprising frame 21 to which is attached eye 22 having opening 26. Rotating spindle 23 is mounted to shaft 21 by pin 24 upon which spindle 23 freely rotates. In the preferred embodiment spindle 23 contains concave surface 25 so that member 10 tends to lie within concave surface 25 when it is rotating about spindle 23 and therefore tends to remain properly engaged and in rotatable position about aperture means 20.

Apertured means 20 is anchored to the ground at a predetermined distance from the trainee's feet by means of anchoring means 40 which comprises a spike 41 which can be easily impressed into the ground and having hooked portion 42. In the preferred embodiment, aperture means 20 is secured to anchoring means 40 by inserting opening 26 over hooked portion 42 or by securing the two by a substantially non-stretchable member which is secured to respective opening 22 and hooked portion 42.

Golfer's aid device 10 may also be used indoors. In this instance, aperture means 20 may be secured to the floor of an indoor structure by any convenient means, and including securing eye 22 by means of a non-stretchable member or cord to a chair or desk leg or other furniture or structures for anchoring the golfer's aid device 10 at a point located in front of and at a predetermined distance from the trainee's feet.

Figure 6:
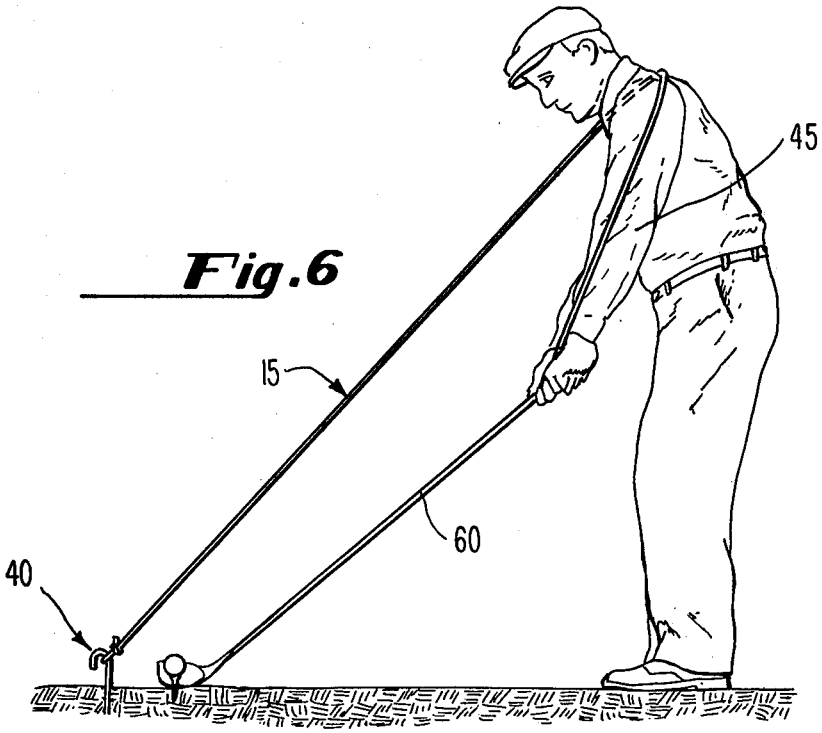
FIG. 6 is a perspective view illustrating use of another feature which can be used in conjunction with the present invention.
Figure 7:
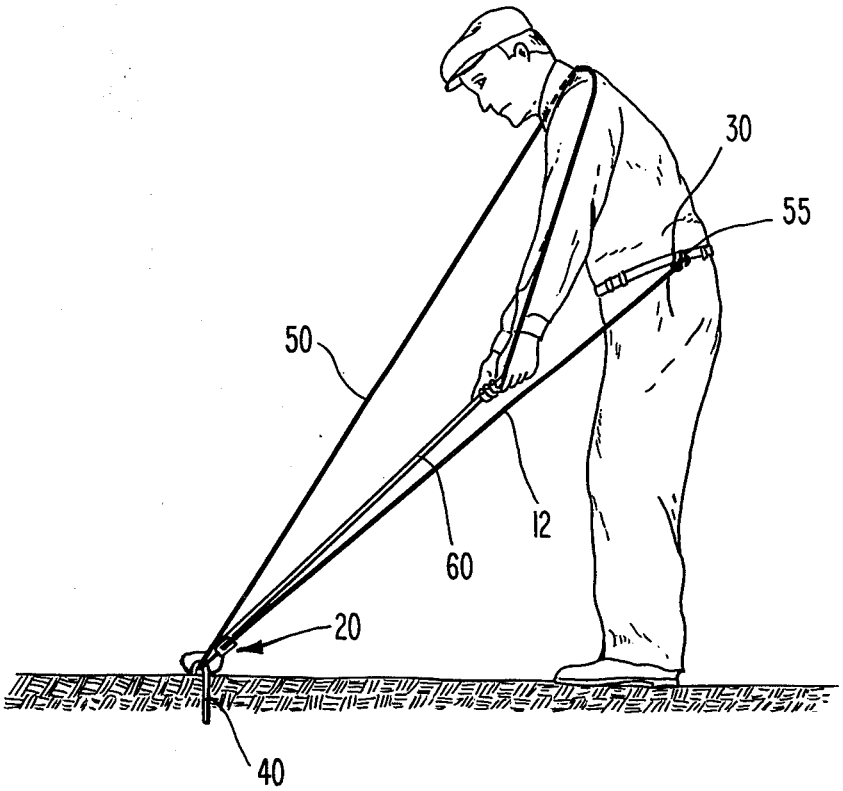
FIG. 7 is a prespective view illustrating the combined use of the present invention as shown in FIG. 5 and FIG. 6.

In yet another embodiment, golfer's aid device 10, as is shown in FIG. 6, contemplates a second member 15 secured to anchoring means 40 the former of which extends upwardly over the trainee's right shoulder (not shown) and around his neck and then downwardly along the trainee's left arm 45 and being grasped in the trainee's left hand (in the instance that trainee is a right-handed golfer.

In describing the preferred mode of use of the golfer's aid 10, reference will be made to positioning the device at a point approximating the proper placement of a golf ball, which is properly addressed (proper golf stance), positioning the device relative to trainee's feet, properly pivoting about golfer's aid device 10 to produce a proper golf swing plane in the back-swing, down-swing, and follow-through. These terms are all known in the art and delineated in *Ben Hogan's Five Lessons--The Modern Fundamentals of Golf,* by Ben Hogan with Herbert Warren Wind, published by A. S. Barnes and Company, New York, New York, 1957, which is incorporated herein by this reference.

Figure 2:
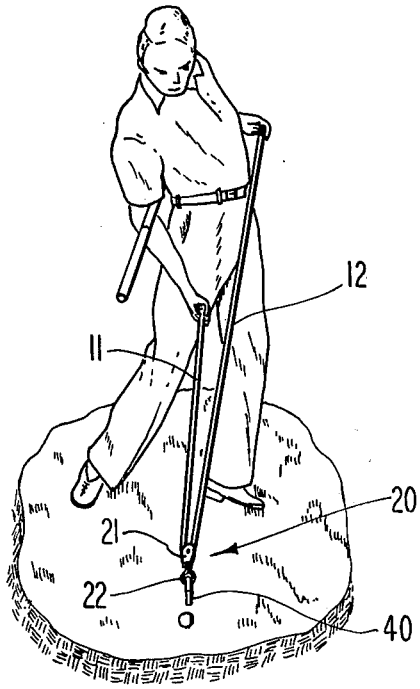
Figure 3:
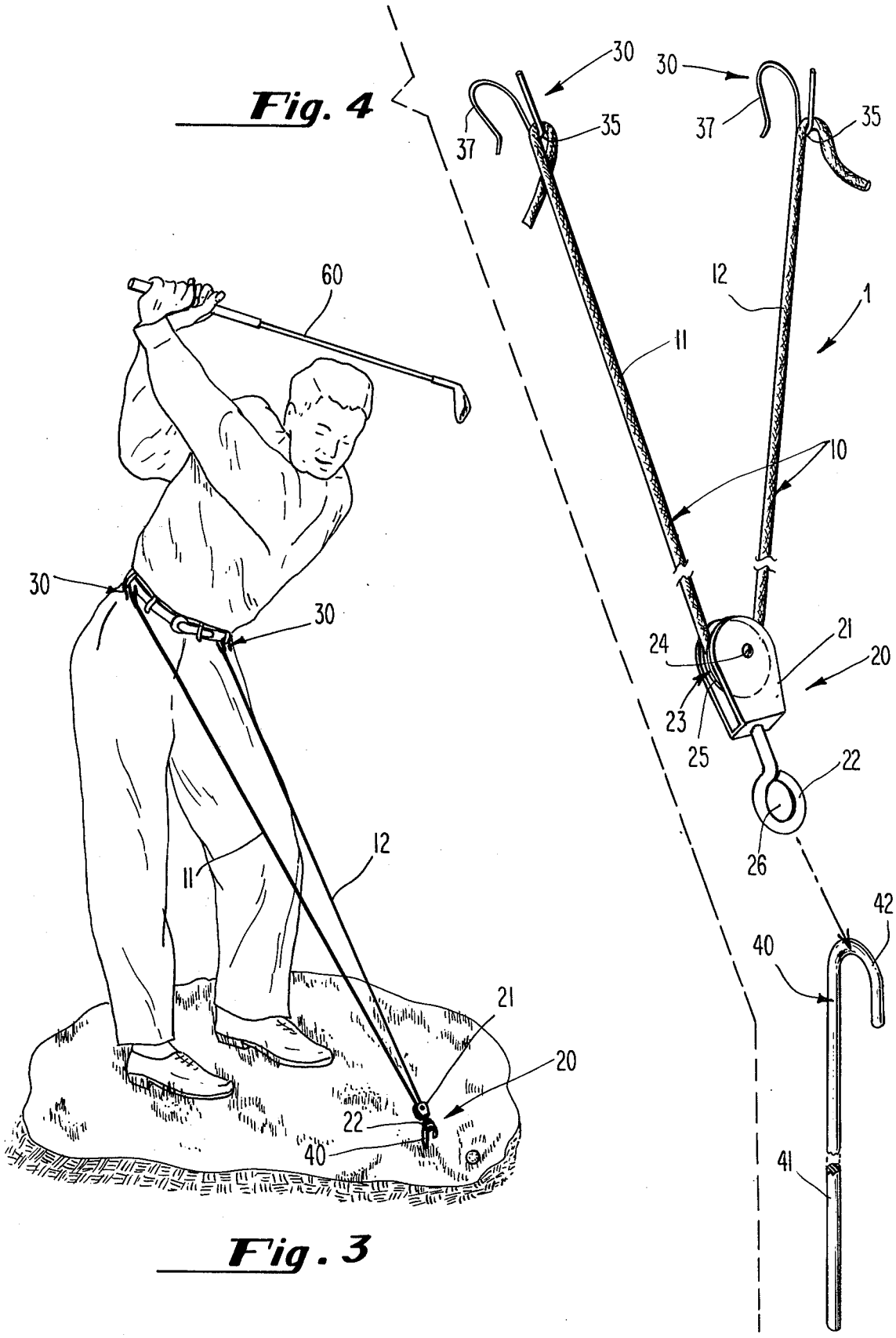
FIG. 3 is a perspective view illustrating the present golfer's aid as it would normally be used by a golfer in practicing the proper pivot while swinging a golf club.

Referring now to FIGS. 1 and 2, the golfer's aid device 10 is used by a trainee to practice pivoting by performing an exercise wherein the trainee bends his arms and retains the upper arm substantially parallel and adjacent to his sides with his forearms bent to receive grasping means 30 (not shown). In the preferred embodiment the trainee retains a golf shaft 50 behind his back by positioning it at the bend in each arm such that it is gripped at the bent portions, as shown, and retained against his back. Shaft 50 as thus far positioned is retained behind the trainee's back and the trainee's arms are bent such that the hands of the trainee properly receive grasping means 30. Golfer's aid 1 is positioned such that anchoring means 40 is in front of trainee's feet at a point approximating the proper placement of a golf ball. Golfer's aid 1, as thus far described, is then adjusted such that portions 11 and 12 of member 10 are retained in taut condition about spindle 23. Moreover, trainee is now properly positioned to pivot about golfer's aid 1 and should now have assumed the proper golf stance prior to pivoting. Having positioned himself properly in relation to golfer's aid 1, trainee properly pivots about golfer's aid 1 during his back-swing by pulling grasping means 30 in his right hand (in the instance of a right-handed golfer) away from aperture means 20 in the same plane as defined by portions 11 and 12 when extended upwardly from spindle 23 to trainee's hands (prior to pivoting), until grasping means 30 in trainee's left hand is pulled downwardly toward apertured means 20 and into contact with portion 11 of member 10 secured in trainee's right hand. At this point the back-swing is completed. It should be noted that in pivoting about golfer's aid device 1, while maintaining the plane as indicated above, that the feet, legs, hips, and shoulders of the trainee are "properly pivoted" through the back-swing and that the legs, hips and shoulders of the trainee are at full stretch when the back-swing is completed. It is also noteworthy that these results are obtained without concentrating on the movement of the feet, legs, hips or shoulders, but are taught by simply concentrating on properly rotating member 10 about apertured means 20. Constant repetition of this exercise will give trainee the proper feel of the back-swing; a back-swing which can be duplicated and repeated without the aid of device 1.

At the termination of trainee's back-swing as thus far described, wherein golfer's aid 1 is positioned as thus far described, trainee is now in a position to begin his down-swing by pulling the grasping means 30 in his left hand (in the instance of a right-handed golfer) through apertured means 20 while maintaining the above-described plane of rotation thereby pulling grasping means 30 in trainee's right hand downwardly toward apertured means 20 and into contact with portion 12 of member 10, which is secured to trainee's left hand. The trainee has thusly completed the down-swing and follow-through, and his feet, legs, hips and shoulders have properly pivoted during the down-swing and follow-through of the golf swing with trainee's legs, hips and shoulders at full stretch after the down-swing and follow-through have been completed. The feel of the proper pivot and results described above with respect to the back-swing are equally applicable to the down-swing and follow-through. The above exercise may be practiced until the feel of the proper pivot is obtained and trainee can repeat the same without resorting to golfer's aid device 1.

Figure 5:
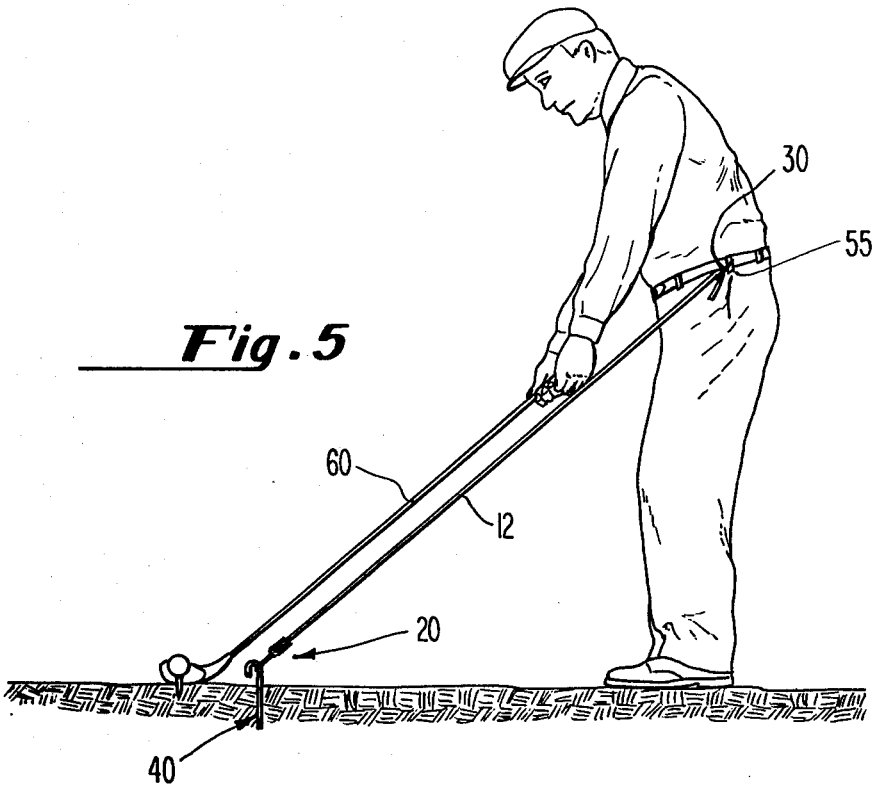
FIG. 5 is a perspective view illustrating another view of the present invention as shown in FIG. 3.

In yet another embodiment for utilization of the golfer's aid device 1, of the present invention, the trainee can practice his pivot while swinging a golf club by anchoring golfer's aid device 1 at a position in front of trainee's feet and at a point closer to trainee's feet than is the point in which the swing plane of golf club 60 contacts a golf ball. See FIGS. 3 and 5. As shown in FIG. 5, the trainee has properly addressed the golf ball and the grasping means 30 are adjusted to engage with opposite sides of the trainee's waist which can be accomplished by attaching grasping means 30 to the belt loops 55. Portions 11 (not shown) and 12 of member 10 should be adjusted such that they extend upwardly from apertured means 20 in taut condition. It should be noted that the same feel as described above with respect to FIGS. 1 and 2, is obtained while properly pivoting about golfer's aid device 1 and that the proper pivot will aid and guide the golf club in its back-swing, down-swing, and follow-through. In this embodiment, portions 11 and 12 of member 10 are maintained in taut condition through the pivot and golf swing.

Still yet another embodiment contemplates the use of golfer's aid device 1 of the present invention by combining the uses illustrated in FIGS. 5 and 6. In this embodiment, golfer's aid device 1 is used as disclosed above with respect to trainee's practicing his pivot while swinging a golf club, and second member 15 (see FIG. 6) is attached to anchoring means 40 and extends upwardly over trainee's right shoulder and around his neck and then downwardly along trainee's left arm and is grasped in trainee's left hand (in the instance that trainee is a right-handed golfer). In this embodiment, anchoring means 40 is positioned just beyond the point where a golf ball should be located in relation to trainee's feet. In beginning the back-swing, second member 15 is maintained in taut condition and gives trainee the feel of how his left shoulder has to come down and then around as he begins his pivot. Moreover, the trainee, prior to beginning his back-swing utilizes second member 15 to define the back-swing plane which inclines upwardly from anchoring means 40 through trainee's shoulders. As the arms approach hip level on the back-swing, they should be moving parallel with the plane and should remain parallel with the plane to the top of the back-swing. As illustrated on page 88 of *Ben Hogan's Five Lessons,* the back-swing plane differs from the down-swing plane and upon properly pivoting, trainee gets on the down-swing plane when he turns his hips to the left to initiate the down swing; the plane for the down-swing being inclined at a shallower angle than the plane of the back-swing, and its lateral axis points slightly to the right of trainee's target.

Still yet a further embodiment contemplates use of two such golfer's aid devices 1 of the present invention to practice pivoting wherein the uses illustrated in FIGS. 1 and 5 are combined. In this embodiment one of the devices 1 is secured to golfer's waist while the other is hand held. In this instance both devices 1 may be anchored by common anchoring means 40.

The golfer's aid device 1 together with the alternative ways in which it may be utilized, as described above or any combination of those embodiments, may be positioned to permit trainee to properly practice pivoting in a shallow plane, a steep plane, or any plane therebetween to obtain the feel of various golf shots which approximate changes in terrain, etc., which will be encountered on the golf course.

It will be understood that the training device disclosed herein can be used equally well by right-handed and left-handed golfers. Accordingly, where the device has been described hereinabove with reference to the left hand of a golfer, it is to be understood that the word "left" as used herein may be equally construed as including the right hand of a left-handed golfer and vice-versa; and that the word "left" as used in the accompanying claims, can be construed to mean "right" and vice versa.

It will be further understood that various changes may be made in the arrangement, design, construction of the parts and utilization of the present invention, without departing from the principles of the invention or the scope of the appended claims.

What is claimed is:

1. A golfer's aid device for trainee's use in practicing proper pivot and golf swing comprising:

a flexible substantially non-stretchable member forming a loop at one end and having a length such that it would extend upwardly in diverging relation to form two portions wherein each said portion further includes grasping means which can be adjusted to non-slipably engage said portions for detachably engaging and securing said portions to opposed side of said trainee in a position approximating the waist of said trainee;

apertured means for engaging said loop and permitting said loop to freely pass therethrough;

anchoring means engageable with said apertured means for anchoring the same at a point located in front of and at a predetermined distance from said trainee's feet, wherein said flexible member has a length sufficient to extend from said apertured means for securing said portions to said trainee; and a second member secured to said anchoring means, said second member having a length such that it would extend upwardly over said trainee's right shoulder and around his neck and then downwardly along said trainee's left arm, said second member being grasped by said left hand.

2. A method for using a golfer's aid device for trainee's use in practicing proper pivot and golf swing, said device having a flexible substantially non-stretchable member forming a loop at one end and having a length such that it would extend upwardly in diverging relation to form two portions wherein each said portion further includes grasping means which can be adjusted to non-slipably engage said portions for securing said portions with each hand of said trainee, apertured means for engaging said loop and permitting said loop to freely pass therethrough, and anchoring means engageable with said apertured means for anchoring the same at a point located in front of and at a predetermined distance from said trainee's feet, said flexible member having a length sufficient to extend from said apertured means to said trainee for securing said portions to said trainee, wherein said trainee practices his pivoting utilizing a shaft and said device, comprising the steps of:

anchoring said device by positioning said anchoring means in front of said trainee's feet at a point approximating the proper placement of a golf ball relative to said trainee's feet;

retaining said shaft behind said trainee's back by positioning it in the bend of each arm;

engaging said grasping means of said device with each hand of said trainee such that portions of said member are retained in taut condition; and pivoting about said device in a manner of the back-swing, down-swing, and follow-through of a complete golf swing.

3. A method for using the golfer's aid device in practicing proper pivot and golf swing as in claim 2, further comprising the step of:

rotating said member through said apertured means by pulling said grasping means in the right hand of said trainee away from said apertured means until said grasping means in the left hand of said trainee is pulled downwardly toward said apertured means and into contact with said portion of said member secured to said right hand of said trainee, whereby said feet, legs, hips and shoulders of said trainee are pivoted in a manner associated with the back-swing of a complete golf swing.

4. In a method for using the golfer's aid device for trainee's use in practicing proper pivot and golf swing as in claim 3, further comprising the step of:

rotating said member through said apertured means by pulling said grasping means in the left hand of said trainee away from said apertured means thereby pulling said grasping means in said right hand of said trainee downwardly toward said apertured means and into contact with said portion of said member secured to said left hand of said trainee, whereby said feet, legs, hips and shoulders of said trainee are pivoted in a manner associated with the down-swing and follow-through of a complete golf swing.

* * * * *